US006371820B1

(12) United States Patent
Neisen et al.

(10) Patent No.: US 6,371,820 B1
(45) Date of Patent: Apr. 16, 2002

(54) INTEGRAL-PIECE GIMBAL RING AND STEERING ASSEMBLY FOR MARINE PROPULSION SYSTEMS

(75) Inventors: Gerald F. Neisen, Rockport, TX (US); Mark Whiteside, Zion, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/574,787

(22) Filed: May 19, 2000

(51) Int. Cl.[7] ..... B63H 5/125
(52) U.S. Cl. ..... 440/57
(58) Field of Search ..... 440/53, 57, 61–63

(56) References Cited

U.S. PATENT DOCUMENTS 4,289,488 A 9/1981 Weronke et al.

4,654,013 A 3/1987 Bland et al.

*Primary Examiner*—Ed Swinehart
(74) *Attorney, Agent, or Firm*—Timothy J. Ziolkowski; Cook & Franke SC

(57) ABSTRACT

A marine propulsion system having an integral-piece gimbal ring and steering means is provided. The system is made up of a gimbal housing affixed through the rear of a boat transom and a gimbal ring pivotally connected to the gimbal housing. The system is further made up of a steering assembly configured to provide pivotal movement of the gimbal ring relative to the gimbal housing about a steering axis. The gimbal ring and the steering assembly comprise an integral-piece assembly.

34 Claims, 5 Drawing Sheets

INTEGRAL-PIECE GIMBAL RING AND STEERING ASSEMBLY FOR MARINE PROPULSION SYSTEMS

BACKGROUND OF THE INVENTION

The present invention is generally related to steering means for marine propulsion systems, and, more particularly, the present invention is related to an integral-piece gimbal ring and steering assembly for a stern drive propulsion system.

Although marine propulsion systems, such as stern drives, provide versatile and proficient means of propulsion to pleasure boats, etc., typical stern drive systems have presented some challenges to boat manufacturers and servicing personnel, such as maintenance and/or assemblage complexity of their steering means to a gimbal ring.

FIG. 1 illustrates a prior art gimbal ring 10 that allows for providing superior boat control by steering about a generally vertical steering axis, and trimming about a generally horizontal axis. Important to the steering function is an upper pivot pin 12 that in cooperation with a cross bolt 14 allows for securing a steering arm 16 to the gimbal ring. Notwithstanding that the parts for providing the steering function may be machined to achieve a tight pivoting joint, due to the effects of various loads, such as may be generated from steering, vibration, wave impact, hydrodynamic side loads, underwater impact, etc., such joint may require frequent servicing to maintain the tight joint.

Further being that pivot pin 12 and gimbal ring 10 comprise separate pieces generally made of different metals or metal alloys, such multi-piece construction may result in cathodic corrosion between one another. For example, in one common arrangement, pivot pin 12 may be made of hardened iron and gimbal ring 10 may be made of aluminum. Once again, frequent servicing may be needed to control corrosion in the joint.

As further shown in FIG. 1, such arrangement generally requires a relatively large number of parts, including square-shaped joint surfaces and mating splines subject to high stress which may become deformed between the relatively soft aluminum gimbal and the hardened pivot pin.

Thus, it would be desirable to provide an integral-piece gimbal ring and steering assembly that allows for overcoming the above-described difficulties.

SUMMARY OF THE INVENTION

Generally speaking, the present invention fulfills the foregoing needs by providing in one embodiment a marine propulsion system made up of a gimbal housing affixed through the rear of a boat transom and a gimbal ring pivotally connected to the gimbal housing. The system is further made up of a steering assembly configured to provide pivotal movement of the gimbal ring relative to the gimbal housing about a steering axis. The gimbal ring and the steering assembly comprise an integral-piece assembly.

The present invention may further fulfill the foregoing needs by providing in another embodiment a method of assembling a marine propulsion system. The method allows for affixing a gimbal housing through the rear of a boat transom. The method further allows for pivotally connecting a gimbal ring to the gimbal housing, and for forming, e.g., casting or welding, or both, an integral-piece gimbal ring and steering assembly configured to provide pivotal movement of the gimbal ring relative to the gimbal housing about a steering axis.

Figure 1:
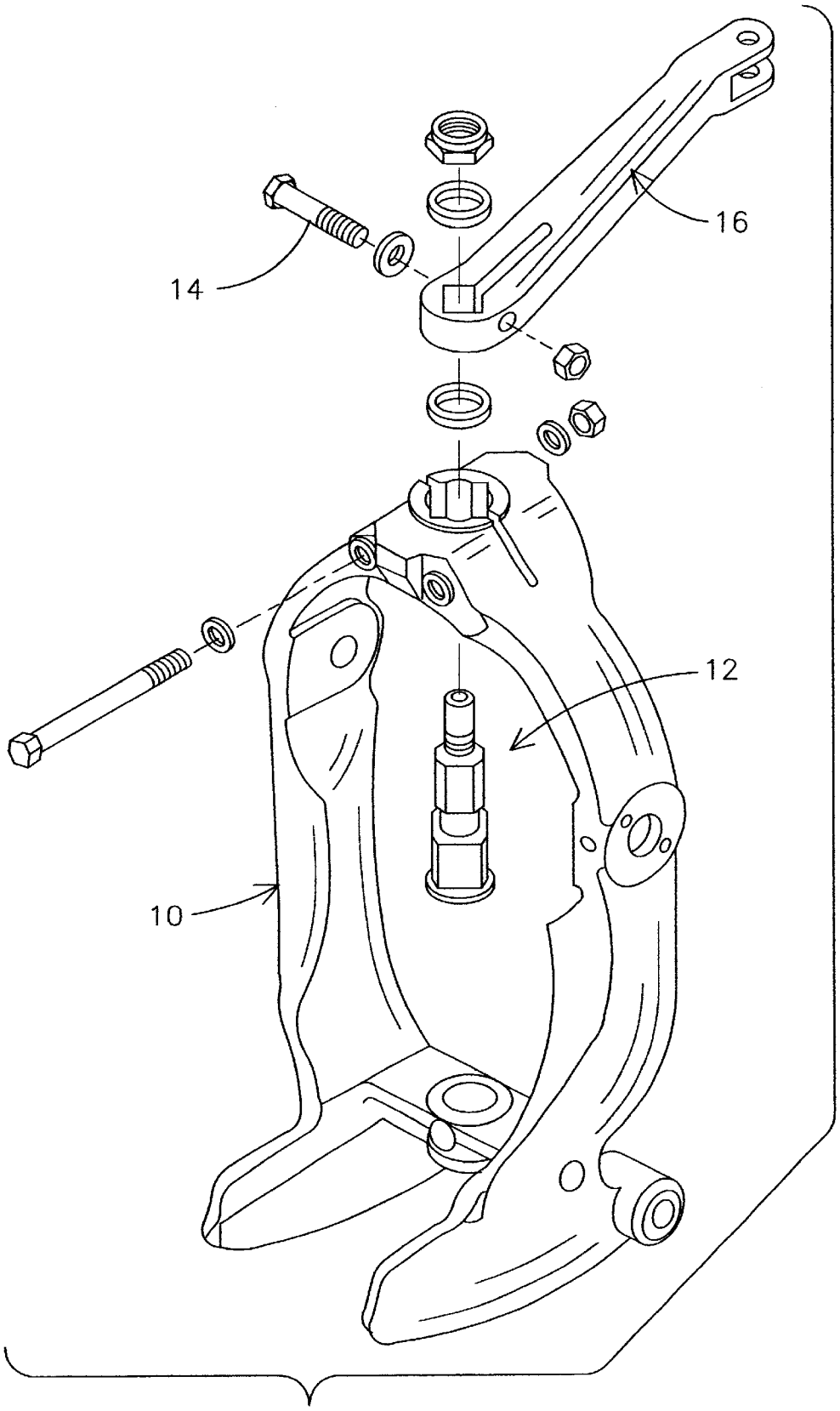
FIG. 1 PRIOR ART
FIG. 1 shows an exploded view of a prior art gimbal ring and steering means.

Before any embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE INVENTION

Figure 2:
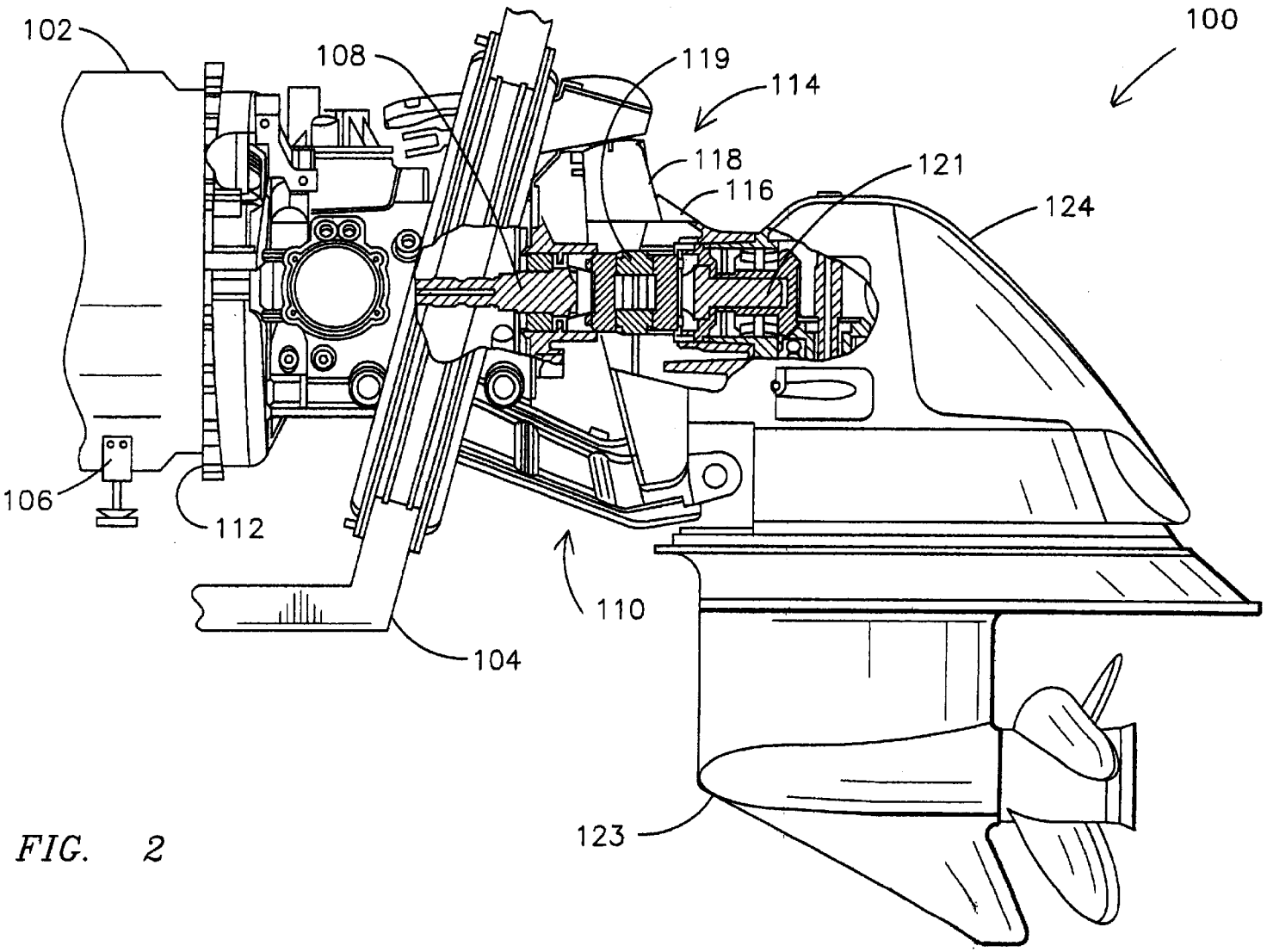
FIG. 2 shows a fragmentary cross-sectional side view of an exemplary marine propulsion system embodying the present invention.

FIG. 2 shows an exemplary marine propulsion system 100 having an engine 102 located within a boat having a transom 104. Standard engine mounts 106 may attach the engine 102 to the boat. The engine 102 provides power through a crankshaft rotating at an engine revolution rate and outputs power to a drive shaft 108. The drive shaft 108 either extends through or is coupled through the transom 104 of the boat. A gimbal housing 110 may extend through the transom 104 to be supported by engine 102 at a suitable mounting flange 112. As will be readily understood by those skilled in the art, the gimbal housing supports a gimbal unit 114, such as may be made up of a pivot housing 116 and a gimbal ring 118. Gimbal unit 114 is horizontally pivotable to provide steering to the boat in a desired direction of travel and is further vertically pivotable to provide, for example, a desired trim relative to the water plane over which the boat travels. Gimbal unit 114 accommodates a universal joint 119 comprising at one end thereof an input shaft, e.g., drive shaft 108, and comprising at an opposite end an output shaft 121 connectable to a propulsion unit 124, generally referred to in the art as vertical drive unit or outdrive, for allowing the vertical and horizontal pivoting. Standard gears and drive-shafts within outdrive 124 in operation cooperate to transmit the power from the output shaft 121 to a propeller shaft located in a lower gearcase 123 appended at the lower end of drive unit 124. Such operation is well-known to those of ordinary skill in the art and need not be described in any greater detail for purposes of the present invention.

Figure 3:
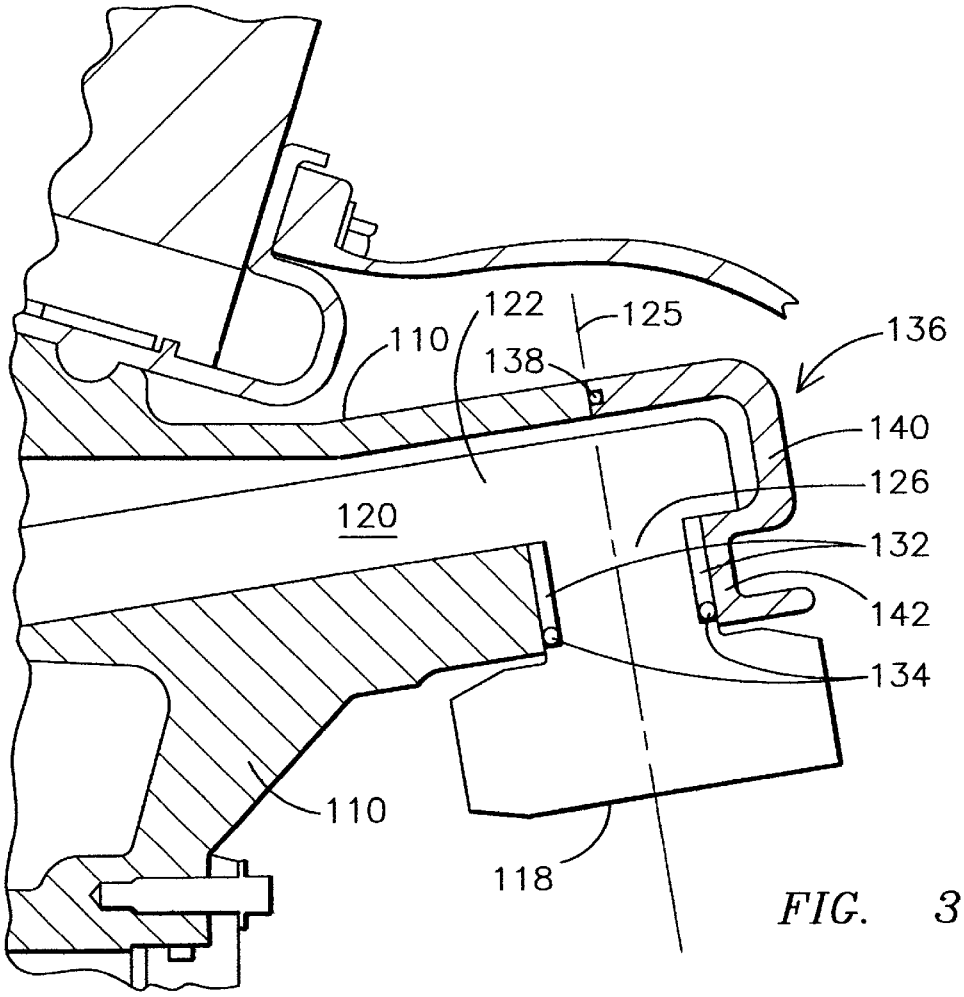
FIG. 3 shows a cross-sectional side view of the single-piece gimbal ring and steering assembly of the present invention.

FIGS. 3 through 6 illustrate respective views of the gimbal ring and steering assembly of the present invention. As shown in FIG. 3, steering assembly 120 and gimbal ring 118 may comprise an integral-piece assembly, such as a single-piece assembly, formed by casting, that is, the integral-piece assembly may be formed by placing a castable substance, such as aluminum or other suitable corrosive-resistant relatively light and high-strength metal or metal alloy, in a mold or form and allowing the castable substance to solidify using casting techniques well-understood by one of ordinary skill in the art. It will be appreciated that the present invention is not limited to a casting construction being that in an alternative embodiment, the integral-piece assembly may be so formed by welding, that is, by joining two metal parts by applying heat to melt and fuse them, with or without filler metal, as would be well-understood by one of ordinary skill in the art.

Figure 5:
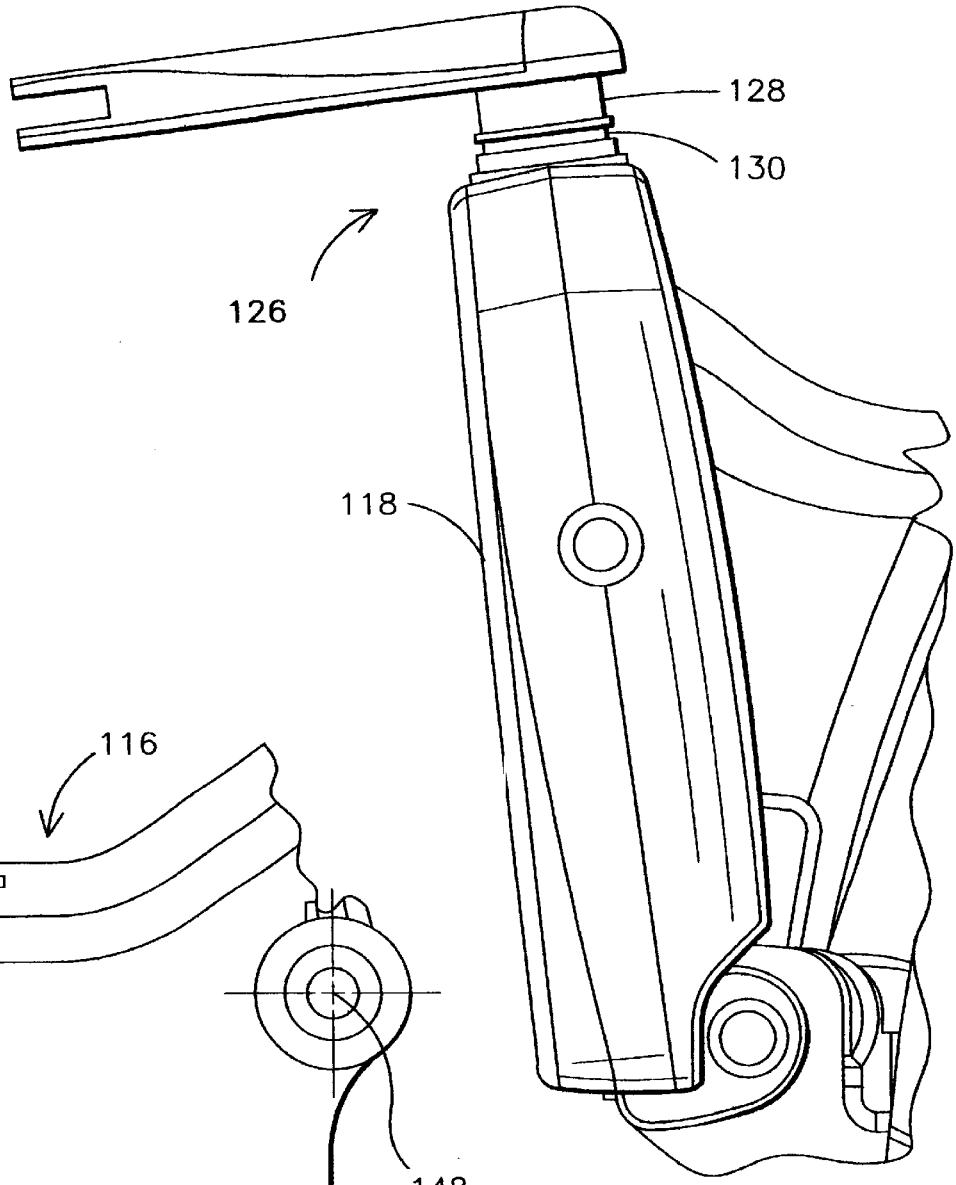
FIG. 5 shows a side elevational view of the gimbal ring and steering assembly of FIG. 3.

The steering assembly comprises a steering arm 122 that extends generally perpendicular relative to a steering axis 125. Steering assembly 120 further comprises a pivot section 126 that connects steering arm 122 to the upper section of the gimbal ring. As best seen in FIG. 5, pivot section 126 includes respective grooves, such as a bearing groove 128 and an O-ring groove 130. Bearing groove 128 receives a suitably-dimensioned bearing 132, such as a steel-bearing or a pivot bushing packed with a Teflon polymer, for allowing pivotal motion of the gimbal ring relative to the gimbal housing about steering axis 125. In one exemplary embodiment, bearing 132 may comprise a split bearing, such as a pivot section bearing composed of two pieces fastened together. O-ring groove 130 receives an O-ring 134 to prevent entry of water through the joint connection, that is, O-ring 134 provides a water-tight seal relative to the pivot section of the steering assembly.

Figure 4:
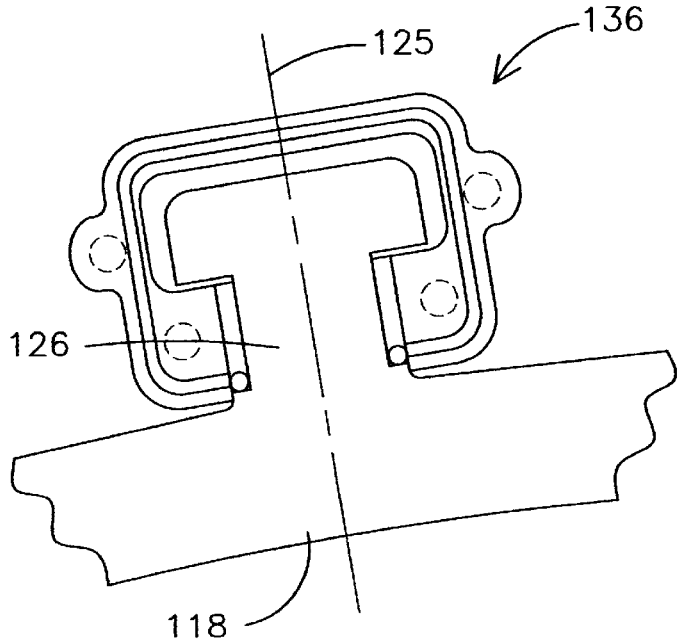
FIG. 4 shows a fragmentary rear elevational view of the gimbal ring and sterring assembly of FIG. 3.

As best seen in FIGS. 3 and 4, a removable cover 136 including a water-tight seal 138 allows for easy access to the integral-piece gimbal ring and steering assembly for installation and/or servicing. Cover 136 may comprise an upper or first section 140 that allows for enclosing the respective end section of steering arm 122 from which the pivot section 126 extends co-axially relative to the steering axis. Cover 136 may further comprise a lower or second section 142 configured to supportively enclose a portion of the pivot section of the steering assembly. Thus, it will be appreciated that a portion of bearing 132 may be pivotally interposed or pressed between a corresponding portion of the gimbal housing and the pivot section, and another portion of bearing 132 may be pivotally interposed or pressed between a corresponding portion of cover 136, e.g., the interior of second cover section 142, and the pivot section.

Figure 7:
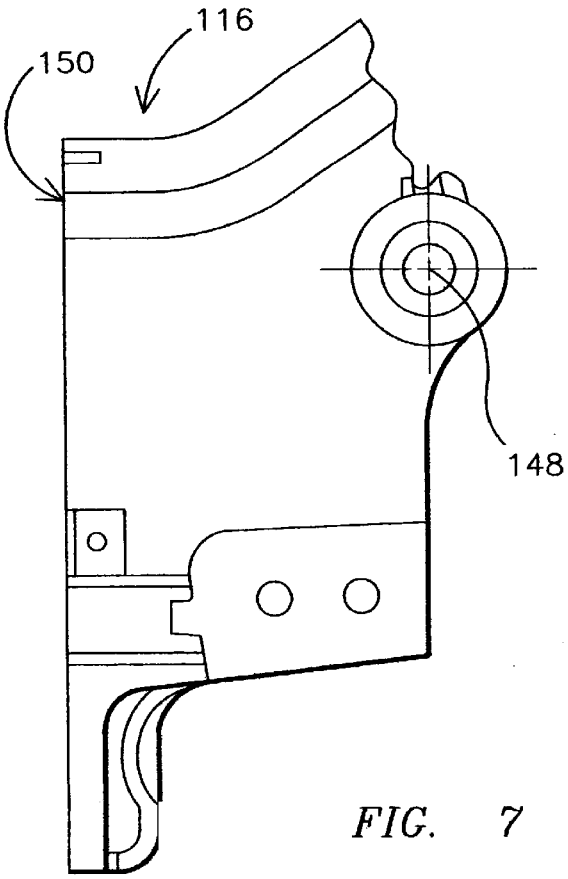
FIG. 7 shows an elevational side view of a tilt housing that may removably connected the integral-piece gimbal ring/steering assembly of the present invention.
Figure 6:
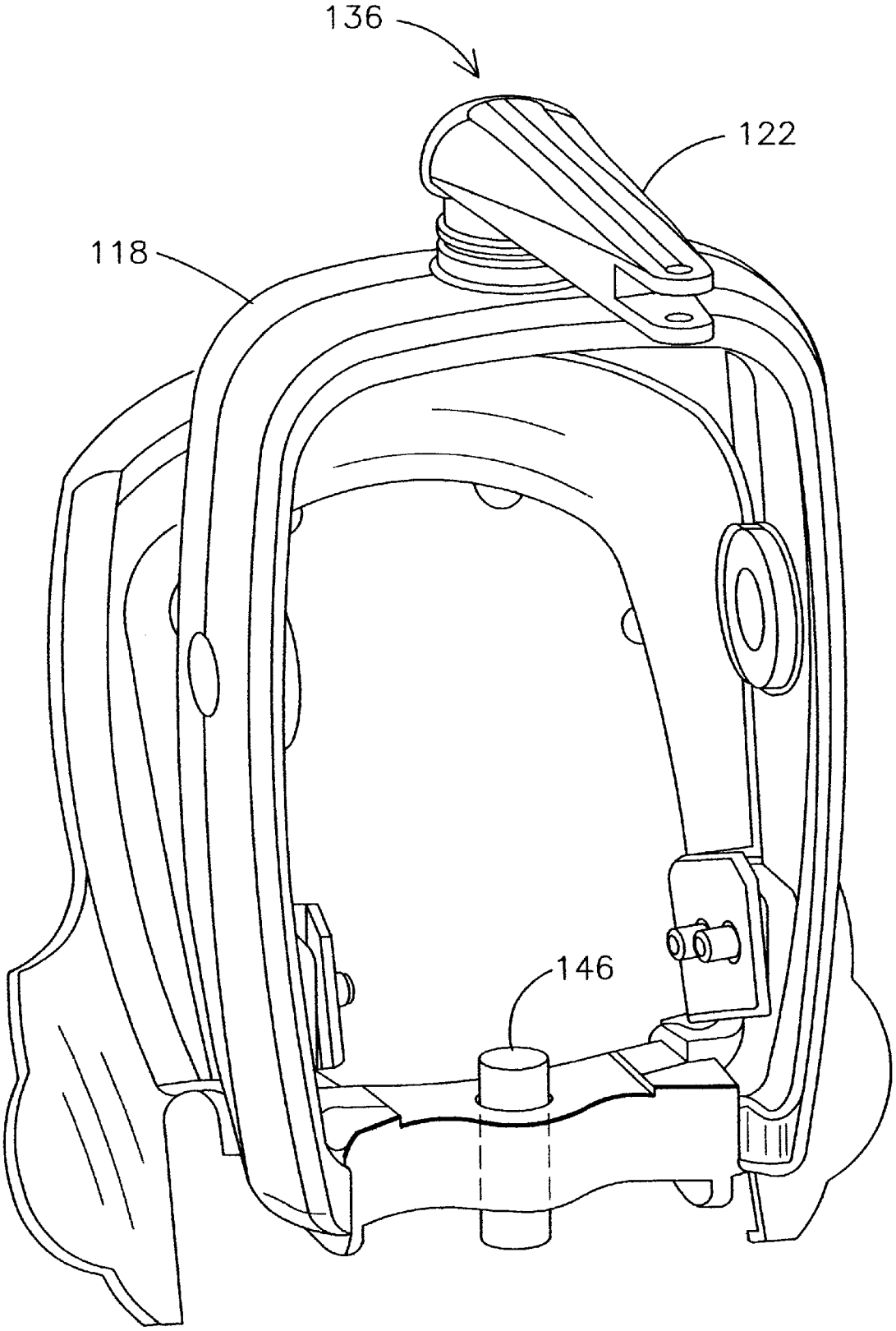
FIG. 6 shows an isometric view of the gimbal ring and steering assembly of FIG. 3.

FIG. 7 illustrates a side view of pivot housing 116 that is removably connected, via a suitable lower pivot subassembly including a lower pivot pin 146, (FIG. 6) to gimbal ring 118 for pivotal movement relative to the gimbal ring about a generally horizontal tilt axis 148. The lower pin 146 (FIG. 6) in operation cooperates with the integral-piece steering assembly 120 for allowing common pivotal movement of pivot housing 116 and gimbal ring 118 relative to the steering axis in response to movement of the steering arm. A mounting surface 150 in pivot housing 116 allows for connecting outdrive 124 (FIG. 2) to pivot housing 116 using bolts or other suitable fastening means. It will be appreciated that lower pivot pin 146 allows for removably connecting the respective lower portions of the gimbal housing and the gimbal ring to one another. As suggested above, the integral-piece gimbal ring and steering assembly may be partly supported by the upper portion of the gimbal housing and partly supported by the lower section of cover 136. Thus, the gimbal ring may be disconnected from the gimbal housing by executing the following actions in any desired sequence: removing lower pivot pin 146 until the respective lower portions of the gimbal housing and gimbal ring are deengaged from one another; and removing cover 136 for accessing and retrieving the integral-piece assembly until the respective upper portions of the gimbal housing and gimbal ring are deengaged from one another.

Tables 1 and 2 allow for comparing the number of parts, such as may be typically required by the prior art gimbal ring and separate steering arrangement discussed in the context of FIG. 1. By way of comparison, the integral gimbal ring/steering assembly of the present invention allows, with a lesser number of parts (Table 2), for easier and more economical servicing as no high stress joints need to be broken for servicing. It will be further appreciated that an additional benefit of the present invention is a less cumbersome process to assemble/disassemble the gimbal unit and associated components.

TABLE 1

Prior Art

| Part | Qty |
|---|---|
| Bearing | 1 |
| Steering arm | 1 |
| Screw | 1 |
| Locknut | 1 |
| Washer | 1 |
| Steering pin, upper | 1 |
| U-bolt | 1 |
| Plate | 1 |
| Locknut | 1 |
| Cap | 1 |
| O-ring | 1 |
| Screw | 4 |
| Pin, lower | 1 |
| Retainer | 1 |
| Gimbal ring | 1 |
| Total Parts | 20 |

TABLE 2

Integral Steering Assembly

| Part | Qty |
|---|---|
| Cover | 1 |
| Seal, face | 1 |
| O-ring | 1 |
| Split bearing | 1 |
| Screw | 4 |
| Gimbal ring | 1 |
| Pin | 1 |
| Retainer | 1 |
| Total Parts | 11 |

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A marine propulsion system comprising;

a gimbal housing affixed through the rear of a boat transom;

a gimbal ring pivotally connected to the gimbal housing; and a steering assembly configured to provide pivotal movement of the gimbal ring relative to the gimbal housing about a steering axis, the gimbal ring and the steering assembly comprising a boltless integral-piece assembly.

2. The marine propulsion system of claim 1 wherein the integral-piece assembly comprises a casting.

3. The marine propulsion system of claim 1 wherein the integral-piece assembly comprises a weldment.

4. The marine propulsion system of claim 2 wherein the steering assembly comprises a steering arm extending generally perpendicular relative to the steering axis.

5. The marine propulsion system of claim 4 wherein the steering assembly further comprises a pivot section extending downwardly from an end portion of the steering arm to connect the steering arm to an upper section of the gimbal ring.

6. The marine propulsion system of claim 5 further comprising a cover removably affixed to the gimbal housing, the cover including first section configured to enclose the end portion of the steering arm.

7. The marine propulsion system of claim 6 wherein the cover further includes a second section configured to supportively enclose the pivot section of the steering assembly.

8. The marine propulsion system of claim 6 wherein the pivot section includes a groove configured to receive a bearing.

9. The marine propulsion system of claim 8 wherein the pivot section further includes a groove configured to receive a water-tight seal relative to the interior of the cover section that supportively encloses the pivot section of the steering assembly.

10. The marine propulsion system of claim 8 wherein the bearing comprises a split bearing.

11. The marine propulsion system of claim 8 wherein a portion of the bearing is pivotally interposed between a corresponding portion of the gimbal housing and the pivot section.

12. The marine propulsion system of claim 11 wherein another portion of the bearing is pivotally interposed between a corresponding interior portion of the cover and the pivot section.

13. The marine propulsion system of claim 12 wherein the corresponding interior portion of the cover is the interior of the second section of the cover.

14. The marine propulsion system of claim 9 wherein the cover includes a groove for receiving a water-tight seal relative to the interior of the gimbal housing that encloses the steering arm.

15. The marine propulsion system of claim 1 comprising a stern drive system.

16. A stern drive system comprising:

a gimbal housing affixed through the rear of a boat transom;

a gimbal ring pivotally connected to the gimbal housing;

a steering assembly configured to provide pivotal movement of the gimbal ring relative to the gimbal housing about a steering axis, wherein the gimbal ring and the steering assembly are formed as a single one-piece assembly; and a pivot housing removably connected to said gimbal ring for pivotal movement relative to the gimbal ring about a generally horizontal tilt axis, and for common pivotal movement with said gimbal ring about the steering axis.

17. The stern drive of claim 16 further comprising a propulsion unit removably connected to a mounting surface of the pivot housing.

18. The stern drive of claim 16 wherein the steering assembly comprises a steering arm extending generally perpendicular relative to the steering axis and said assembly further comprises a pivot section extending downwardly from an end portion of the steering arm to connect the steering arm to an upper section of the gimbal ring and wherein the integral-piece gimbal ring and steering assembly are integrally formed by casting.

19. The stern drive of claim 16 wherein the steering assembly comprises a steering arm extending generally perpendicular relative to the steering axis and said assembly further comprises a pivot section extending downwardly from an end portion of the steering arm to connect the steering arm to an upper section of the gimbal ring and wherein the integral-piece gimbal ring and steering assembly are integrally joined by welding.

20. The stern drive of claim 17 further comprising a cover removably affixed to the gimbal housing to enclose at least the end portion of the steering arm.

21. The stern drive of claim 20 wherein the pivot section includes a groove configured to receive a bearing, the pivot section further comprising a groove configured to receive a water-tight seal relative to the interior of the cover.

22. The stern drive of claim 21 wherein the bearing comprises a split bearing.

23. The stern drive of claim 21 wherein a portion of the bearing is pivotally interposed between a corresponding portion of the gimbal housing and the pivot section and wherein another portion of the bearing is pivotally interposed between a corresponding portion of the cover and the pivot section.

24. The stern drive of claim 20 wherein the cover includes a groove for receiving a water-tight seal relative to the interior of the gimbal housing that encloses the steering arm.

25. A marine propulsion unit comprising;

a gimbal housing configured to be fixedly attached through the rear of a boat transom;

a gimbal ring pivotally connected to said gimbal housing;

a steering assembly comprising a steering arm and a pivot section to provide for pivotal movement of said gimbal ring relative to said gimbal housing about the steering axis in response to steering arm movement, the gimbal ring and the steering assembly comprising an integral-piece assembly formed by casting;

a cover disposed rearwardly of the gimbal housing for accessing the integral-piece assembly; and wherein the pivot section includes a groove configured to receive a split bearing so that a portion of the bearing is pivotally interposed between a corresponding portion of the gimbal housing and the pivot section and wherein another portion of the bearing is pivotally interposed between a corresponding portion of the cover and the pivot section.

26. The marine propulsion system of claim 25 wherein the cover comprises a first section configured to enclose the end portion of the steering arm, the cover further comprising a second section configured to supportively enclose the pivot section of the steering assembly.

27. The marine propulsion system of claim 25 wherein the pivot section further includes a groove configured to receive a water-tight seal relative to the interior of the cover.

28. The marine propulsion system of claim 25 wherein the cover comprises a water-tight cover relative to the interior of the gimbal housing that encloses the steering arm.

29. A marine propulsion unit comprising:

a gimbal housing configured to be fixedly attached through the rear of a boat transom;

a gimbal ring pivotally connected to said gimbal housing;

a steering assembly comprising a steering arm and a pivot section to provide for pivotal movement of said gimbal ring relative to said gimbal housing about the steering axis in response to steering arm movement, the gimbal ring and the steering assembly comprising a non-disassemblable integral-piece assembly having fewer than 20 components; and a cover disposed rearward of the gimbal housing for accessing the integral-piece assembly and wherein the cover comprises a first section configured to enclose the end portion of the steering arm, the cover further comprising a second section configured to supportively enclose the pivot section of the steering assembly.

30. A marine propulsion unit comprising;

a gimbal housing configured to be fixedly attached through the rear of a boat transom, the gimbal housing including an upper portion and a lower portion;

a gimbal ring having respective upper and lower portions pivotally connected to said gimbal housing;

a steering assembly pivotally supported at least by the upper portion of the gimbal housing, the steering assembly comprising a steering arm and a pivot section to provide pivotal movement of said gimbal ring relative to said gimbal housing about the steering axis in response to steering arm movement, the gimbal ring and the steering assembly comprising an integral assembly that is formed as a one-piece assembly and is not capable of disassembly and re-assembly;

a cover disposed rearwardly of the gimbal housing for accessing and supporting the integral-piece assembly;

a lower pivot pin for connecting the respective lower portions of the gimbal housing and the gimbal ring to one another, said gimbal ring being disconnected from said gimbal housing by removing said lower pivot pin until the respective lower portions of the gimbal housing and gimbal ring are deengaged from one another, and further by removing said cover for accessing the integral-piece assembly until the respective upper portions of the gimbal housing and gimbal ring arc deengaged from one another.

31. A method of assembling a marine propulsion system, the method comprising;

affixing a gimbal housing through the rear of a boat transom;

pivotally connecting a gimbal ring to the gimbal housing; and forming a one-piece, integral gimbal ring and steering assembly configured to provide pivotal movement of the gimbal ring relative to the gimbal housing about a steering axis.

32. The method of claim 31 wherein the forming step comprises casting the integral-piece assembly.

33. The method of claim 31 wherein the forming step comprises welding the integral-piece assembly.

34. A marine propulsion system comprising:

means for housing a gimbal unit, the gimbal housing means being configured to be positioned through the rear of a boat transom;

gimbal ring means in the gimbal unit for providing two degrees of freedom of movement to a propulsion unit, the gimbal ring being pivotally connected to said gimbal housing means;

steering assembly means removably connected to the gimbal housing means and including steering arm means and pivot means for enabling pivotal movement of said gimbal ring means relative to said gimbal housing means about an steering axis in response to movement of the steering arm means, the gimbal ring means and the steering assembly means formed as a single-piece not capable of disassembly;

pivot housing means removably connected to said gimbal ring means for pivotal movement relative to the gimbal ring means about a generally horizontal tilt axis, and for common pivotal movement with said gimbal ring means about the steering axis, the propulsion unit being removably connected to the pivot housing means; and cover means for accessing the integral-piece assembly and wherein the cover means comprises means for enclosing the end portion of the steering arm means, the cover means further comprising means for supportively enclosing the pivot means of the steering assembly.

* * * * *